US008869843B2

(12) United States Patent
Tague et al.

(10) Patent No.: US 8,869,843 B2
(45) Date of Patent: Oct. 28, 2014

(54) FUEL NOZZLE BREAKAWAY PREVENTION SAFETY SYSTEM

(76) Inventors: Johnie Lee Tague, Anaheim Hills, CA (US); Michael James Noble, Yorba Linda, CA (US)

( * ) Notice: Subject to any disclaimer, the term of this patent is extended or adjusted under 35 U.S.C. 154(b) by 469 days.

(21) Appl. No.: 13/186,284

(22) Filed: Jul. 19, 2011

(65) Prior Publication Data

US 2012/0018446 A1 Jan. 26, 2012

Related U.S. Application Data

(60) Provisional application No. 61/365,931, filed on Jul. 20, 2010.

(51) Int. Cl.
*B67D 7/32* (2010.01)
*B67D 7/06* (2010.01)
*B67D 7/04* (2010.01)

(52) U.S. Cl.
CPC *B67D 7/064* (2013.01); *B67D 7/32* (2013.01); *B67D 7/3218* (2013.01); *B67D 7/04* (2013.01)
USPC ..... 141/94; 141/1; 141/98; 222/28; 222/39

(58) Field of Classification Search
CPC ..... B67D 7/04; B67D 7/064; B67D 7/32; B67D 7/3218
USPC ..... 141/1, 94, 98; 222/23, 25, 28, 39
See application file for complete search history.

(56) References Cited

U.S. PATENT DOCUMENTS

| | | | | |
|---|---|---|---|---|
| 4,250,550 | A * | 2/1981 | Fleischer | 705/413 |
| 4,726,492 | A * | 2/1988 | Komukai | 222/14 |
| 5,134,716 | A * | 7/1992 | Craig | 455/66.1 |
| 5,506,570 | A * | 4/1996 | Scott et al. | 340/603 |
| 5,720,327 | A * | 2/1998 | Foster, Jr. | 141/94 |
| 6,334,474 | B1 * | 1/2002 | Rababy et al. | 141/94 |
| 6,631,577 | B1 * | 10/2003 | Madison | 40/591 |
| 6,899,151 | B1 * | 5/2005 | Latka et al. | 141/392 |
| 7,021,345 | B2 * | 4/2006 | Webb | 141/98 |
| 8,397,768 | B2 * | 3/2013 | Benik | 141/94 |
| 2013/0025698 | A1 * | 1/2013 | Safi-Samghabadi et al. | 137/68.18 |

* cited by examiner

*Primary Examiner* — Nicolas A Arnett

(57) ABSTRACT

A breakaway separation prevention safety device that provides warning indicators reminding users to replace a fuel nozzle after dispensing fuel. The safety warning system reminds users of a fuel pump to replace the nozzle into the nozzle mount. The system is activated as the user removes the nozzle from the nozzle mount. An audio and visual warning is emitted as a reminder for the user.

7 Claims, 3 Drawing Sheets

FUEL NOZZLE BREAKAWAY PREVENTION SAFETY SYSTEM

The current application claims a priority to the U.S. Provisional Patent application Ser. No. 61/365,931 filed on Jul. 20, 2010.

FIELD OF THE INVENTION

The present invention relates generally to a safety system for self-service fuel pumps at gasoline stations. More specifically, the present invention is a safety alert system that warns users about the absence of the fuel nozzle from the nozzle mount on the pump. As a result, the user is reminded to remove the nozzle from their cars and replace the nozzle onto the pump.

BACKGROUND OF THE INVENTION

In recent years, self-service fuel pumps at gasoline stations have become the industry standard. The majority of fuel pumps at gasoline stations are self-service as opposed to full-service. Many consumers prefer to pump their own fuel due to a lower cost. By providing self-service, gasoline stations do not have the extra expense of hiring employees. Self-service fuel pumps allow individual consumers to pump their own gasoline without the need for trained employees to help perform such a service. However, self-service stations open the operation of the gasoline pumps to all types of users. The consequence of providing self-service gasoline pumps at the gasoline stations is that it can be operated by careless, forgetful, or rushed users. Such types of users are prone to forget the removal and replacement of the fuel nozzle to the nozzle mount on the gasoline pump. As a result, the users will drive off while the nozzles are still inserted in their vehicles. The force of the car pulling away causes the hose to be ripped off of the gasoline station. This situation, which is commonly referred to as a "breakaway separation", a "drive off", or a "drive away", can be very dangerous and expensive. The consequences of a breakaway separation can include, a large gasoline leak, damage to the gasoline pump, and damage to the user's vehicle. A large gasoline leak is a large hazard as ignition of the spilled gasoline can result in a large disaster. A large gas station having four islands of three pumps per island may experience at least one to two breakaway separations conditions per month on average.

To address this problem, the present invention introduces a safety system that is able to effectively remind a gas pump user to remove the nozzle from their vehicle and replace it back onto the pump. The safety system provides a visual and audio reminder that is activated by the removal of the nozzle from the gas pump. The visual indicator continually provides a visual reminder and is positioned evidently on the gas pump to increase its chance of being seen. Additionally, the present invention provides a continual, periodical, or one-time audio reminder for the patron to replace the nozzle when they have finished filling their vehicle. By providing very evident reminder to replace a fuel nozzle to the gas pump, the chances of a breakaway separation from occurring is significantly reduce. The present invention saves the gas station owners and the vehicle drivers from any embarrassment or the cost of damage repair to the gas pump or the vehicle.

DETAIL DESCRIPTIONS OF THE INVENTION

All illustrations of the drawings are for the purpose of describing selected versions of the present invention and are not intended to limit the scope of the present invention.

Figure 1:
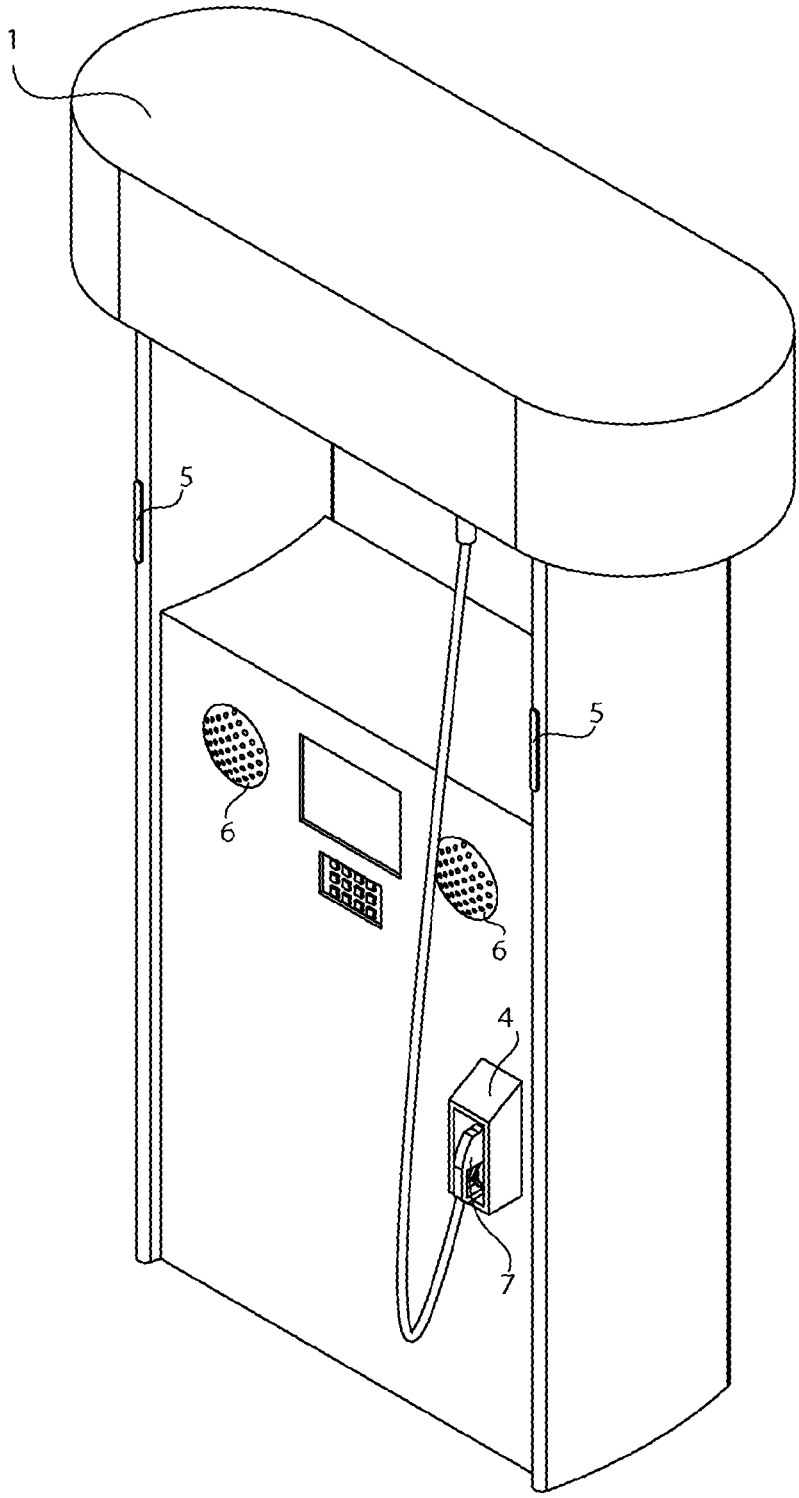
FIG. 1 is a perspective view of a fuel dispensing station enclosure with the present invention installed for breakaway separation prevention.
Figure 2:
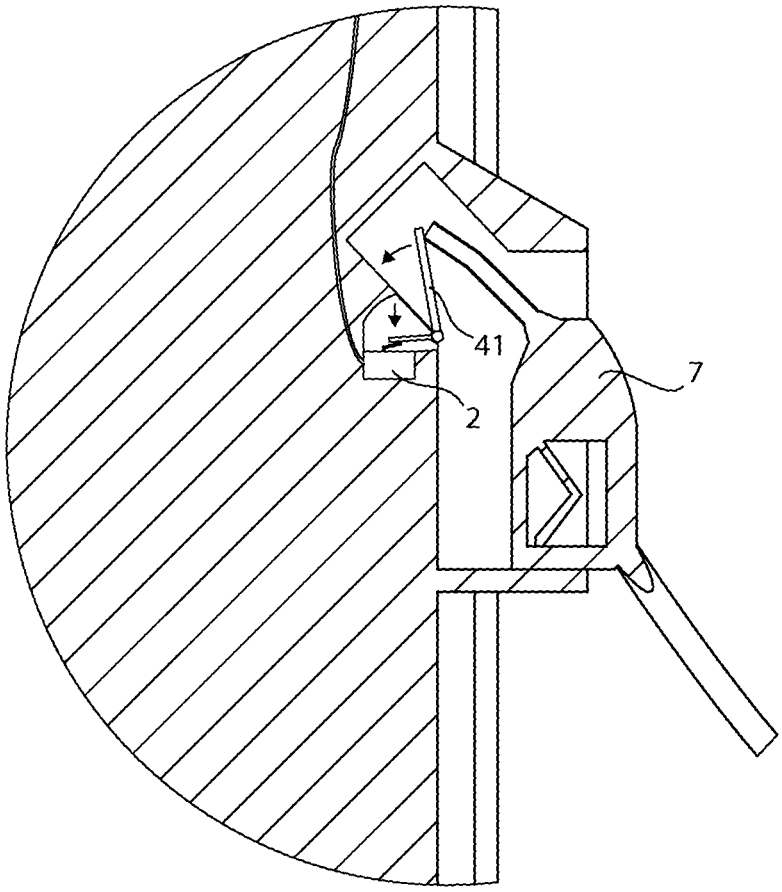
FIG. 2 is a detailed cross sectional view of the nozzle mount. The limit switch is shown interacting with the nozzle door.
Figure 3:
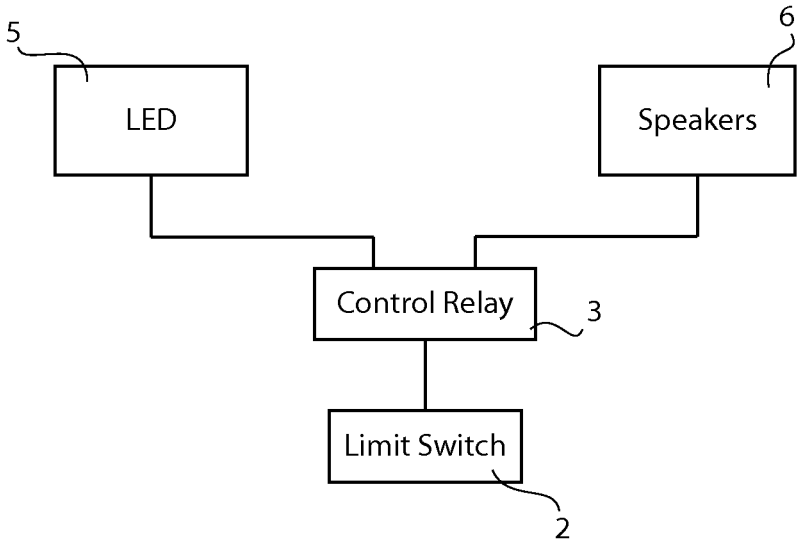
FIG. 3 is a connectivity diagram showing the interaction of electrical components that activates the visual indicator and the audio indicator. The limit switch activates the control relay which in turn activates or deactivates the visual indicator and audio indicator.

The present invention is a breakaway separation prevention system for a fuel dispensing station enclosure 1 that comprises a limit switch 2, a nozzle mount 4, a fuel nozzle 7, a visual indicator 5, and an audio indicator 6. In reference to FIG. 1-3, the nozzle mount 4 is positioned on the fuel dispensing station enclosure 1. The nozzle mount 4 further comprises of a nozzle door 41. The nozzle door 41 is positioned within and is jointly connected to the nozzle mount 4. The limit switch 2 is mounted on the inside of the fuel dispensing station enclosure 1. The limit switch 2 connects to the nozzle door 41 and consequently activates or deactivates a circuit control relay 3. The circuit control relay 3 is a normally open circuit switch that is electrically connected to the visual indicator 5 and the audio indicator 6. The circuit control relay 3 completes or disconnects a circuit for the visual indicator 5 and the audio indicator 6 for activation or deactivation. The visual indicator 5 and the audio indicator 6 are both positioned on the fuel dispensing station enclosure 1. The visual indicator 5 can by any type of lighting indicator from an LED light strip, a LED light patch, or individual pluralities of LEDs. However, in the preferred embodiment of the present invention, the visual indicator 5 is a warning light fixture made with a red LED light strip. The visual indicator 5 is mounted on the outside of the fuel dispensing station enclosure 1. There can be a plurality of the visual indicator 5s mounted on the fuel dispensing station enclosure 1 to maximize the chance of a user noticing the light reminder. The audio indicator 6 is a speaker that is mounted inside the fuel dispensing station enclosure 1. The audio indicator 6 and the visual indicator 5 are simultaneously activated when the user removes the nozzle 7 from the nozzle mount 4.

In an inactive positioned, the nozzle 7 is positioned and docked onto the nozzle mount 4. The nozzle door 41 is secured in an open position as the nozzle 7 is inserted into and placed on the nozzle mount 4. With the nozzle door 41 in an open position the limit switch 2 is also secured in an open position. The open limit switch 2 keeps the circuit control relay 3 in an open position as well. The open position keeps the audio indicator 6 and the visual indicator 5 inactive.

To use the present invention, a patron of a gas station simply follows the normal procedure for paying and removing the nozzle 7 to fill their vehicle. By removing the nozzle 7 from the nozzle mount 4, the nozzle door 41 is released from an open position into a closed position. The releasing of the nozzle door 41 switches the limit switch 2 into a closed position. As a result, the limit switch 2 causes the circuit control relay 3 to move from a normally open position into a closed position. The closing of the circuit control relay 3 completes the circuit of for the activation of the visual indicator 5 and the audio indicator 6. The activation of the visual indicator 5 and the audio indicator 6 allows the present invention to emit a warming signal notifying and reminding the gas station patron to replace the fuel nozzle 7 back into the nozzle mount 4. In the preferred embodiment of the present invention, the visual indicator 5 is a red LED light strip that emits a sequential oscillating light. However, in other embodiments of the present invention, the visual indicator 5 can also be an patch array of LED lights that emit a flashing lights with varying frequencies depending on the preferred settings. The visual indicator 5 can also notify and remind a gas station patron to replace the nozzle 7 by other means including lights with different illuminating patterns. In the preferred embodiment of the present invention, the warning signal emitted by the audio indicator 6 is a pre-recorded message with notification reminder to replace the fuel nozzle 7. In an embodiment of the present invention, the audible warning message by the audio indicator 6 can say, "Please remember to return the fuel nozzle 7 after dispensing fuel. The red LED warning lights will continue to flash until the nozzle 7 is returned to the dispenser." The audible warning message can be played continuously as the user is filling their vehicle with gasoline, or periodically at predetermined time intervals.

When the dispensing of fuel has been completed, the fuel nozzle 7 is to be returned to the nozzle mount 4 on the fuel dispensing station enclosure 1. When the fuel nozzle 7 is replaced onto the nozzle mount 4, the nozzle door 41 and the limit switch 2 inside the fuel dispensing station enclosure 1 are once again secured back into their normal open position. Consequently, the circuit control relay 3s are returned to a open position as well. The opening of the circuit control relay 3 breaks the visual indicator 5 and the audio indicator 6 off from the circuit. The red LED light strip and the audio speaker are turned off until another gas station patron stops to fill their vehicle.

As with any electronic system in a gas station, it is important for each electronic component to be insulated and sealed. The audio indicator 6 and the visual indicator 5 are to be connected to the fuel dispensing station enclosure 1 by a seal. Additionally, the circuit control relay 3 is positioned within the fuel dispensing station enclosure 1 away from any and all flammable gasoline. Such safety precautions are necessary to protect each and all patrons utilizing a gasoline station.

Although the invention has been explained in relation to its preferred embodiment, it is to be understood that many other possible modifications and variations can be made without departing from the spirit and scope of the invention as hereinafter claimed.

What is claimed is:

1. A fuel nozzle breakaway prevention safety system comprises,
- a fuel dispensing station enclosure;
- a limit switch;
- a nozzle;
- a nozzle mount;
- a visual indicator;
- an audio indicator;
- a circuit control relay;
- the nozzle mount comprises a nozzle door;
- the nozzle being positioned on the nozzle mount;
- the nozzle door being secured by the nozzle, wherein the limit switch is resultantly secured in an open position;
- the nozzle mount being positioned on the fuel dispensing station enclosure;
- the nozzle door being positioned within and jointly connected the nozzle mount
- the limit switch being connected to the nozzle door;
- the visual indicator being positioned on the fuel dispensing station enclosure;
- the audio indicator being positioned on the fuel dispensing station enclosure;
- the circuit control relay being connected to the limit switch;
- the circuit control relay being electrically connected to the visual indicator and the audio indicator; and
- the circuit control relay being a normally open circuit switch.

2. The fuel nozzle breakaway prevention safety system as claimed in claim 1 comprises,
- wherein the visual indicator is an LED light strip.

3. The fuel nozzle breakaway prevention safety system as claimed in claim 1 comprises,
- wherein the audio indicator is a speaker.

4. A method of using a fuel nozzle breakaway prevention safety system comprises,
- providing a fuel dispensing station, wherein an enclosure of the fuel dispensing station consists of a limit switch, a nozzle, a nozzle mount having a nozzle door, a visual indicator, and an audio indicator, the limit switch being connected to the nozzle door;
- removing of the nozzle from the nozzle mount;
- releasing of the limit switch from a normally open position to a closed position;
- closing a circuit control relay, the circuit control relay being connected to the limit switch;
- activating the visual indicator and the audio indicator via the control circuit relay; and
- emitting of warning signal;
- wherein the warning signal is emitted by the visual indicator and the audio indicator.

5. The method of using the fuel nozzle breakaway prevention safety system as claimed in claim 4 comprises,
- wherein the warning signal emitted by the visual indicator can be a oscillating light or a flashing light of any color.

6. The method of using the fuel nozzle breakaway prevention safety system as claimed in claim 4 comprises,
- wherein the warning signal emitted by the audio indicator is a prerecorded message with notification reminder to replace the nozzle onto the nozzle mount.

7. A fuel nozzle breakaway prevention safety system comprises,
- a fuel dispensing station enclosure;
- a limit switch;
- a nozzle;
- a nozzle mount;
- a visual indicator;
- an audio indicator;
- the nozzle mount comprises a nozzle door;
- the nozzle mount being positioned on the fuel dispensing station enclosure;
- the nozzle door being positioned within and jointly connected the nozzle mount;
- the limit switch being connected to the nozzle door;
- the visual indicator being positioned on the fuel dispensing station enclosure;
- the audio indicator being positioned on the fuel dispensing station enclosure;
- a circuit control relay;
- the circuit control relay being connected to the limit switch;
- the circuit control relay being electrically connected to the visual indicator and the audio indicator;
- the circuit control relay being a normally open circuit switch;
- wherein the visual indicator is an LED light strip;
- wherein the audio indicator is a speaker;
- the nozzle being positioned on the nozzle mount; and the nozzle door being secured by the nozzle, wherein the limit switch is resultantly secured in an open position.

* * * * *